US009016509B2

(12) United States Patent
Santy et al.

(10) Patent No.: US 9,016,509 B2
(45) Date of Patent: Apr. 28, 2015

(54) DRIP TRAY AND BASE ASSEMBLY FOR A BEVERAGE DISPENSING URN

(71) Applicant: Schroeder Industries, Inc., San Antonio, TX (US)

(72) Inventors: David Santy, Converse, TX (US); Deborah Absalon, Converse, TX (US)

(73) Assignee: Schroeder Industries, Inc., San Antonio, TX (US)

( * ) Notice: Subject to any disclaimer, the term of this patent is extended or adjusted under 35 U.S.C. 154(b) by 376 days.

(21) Appl. No.: 13/672,788

(22) Filed: Nov. 9, 2012

(65) Prior Publication Data

US 2013/0126536 A1 May 23, 2013

Related U.S. Application Data

(60) Provisional application No. 61/561,558, filed on Nov. 18, 2011.

(51) Int. Cl.

| | |
|---|---|
| ***B65D 1/34*** | (2006.01) |
| ***B65D 1/16*** | (2006.01) |
| ***B67D 1/16*** | (2006.01) |

(52) U.S. Cl.

CPC ... *B65D 1/34* (2013.01); *B67D 1/16* (2013.01)

(58) Field of Classification Search

USPC ..... 220/571; 137/312, 313; 99/400; 141/86, 141/88; 222/108, 109

See application file for complete search history.

(56) References Cited

U.S. PATENT DOCUMENTS

| | | | | |
|---|---|---|---|---|
| 5,827,428 | A * | 10/1998 | Chang | 210/248 |
| 6,619,507 | B2 * | 9/2003 | Lassota | 222/108 |
| 2009/0236364 | A1 * | 9/2009 | Njaastad et al. | 222/108 |
| 2010/0187258 | A1 * | 7/2010 | Santy et al. | 222/129.1 |
| 2011/0041542 | A1 * | 2/2011 | Brunner et al. | 62/344 |

* cited by examiner

*Primary Examiner* — Fenn Mathew
*Assistant Examiner* — Don M Anderson
(74) *Attorney, Agent, or Firm* — Jackson Walker, LLP

(57) ABSTRACT

A drip tray and base assembly for a beverage dispensing apparatus is disclosed. The drip tray and base assembly includes a base for supporting an urn in spaced apart relation above a support surface, such as a counter. The base typically has side walls and a top wall. A drip tray is provided for laying adjacent the base. The drip tray typically has an upper grill-like surface for receiving a cup, container or other receptacle thereon, as well as side walls and a floor. At least one of the side walls of the drip tray is configured with a drain extension for draining fluids accumulating on the floor of the drip tray. A coupling member with walls adapted to removably couple with the base is provided. Furthermore, a coupling member includes walls for removably and fluid sealingly coupling with the drip tray extension and with a drain line so as to carry fluid accumulating on the floor of the drip tray through the drip tray drain extension into a drain line.

14 Claims, 9 Drawing Sheets

DRIP TRAY AND BASE ASSEMBLY FOR A BEVERAGE DISPENSING URN

This application claims the benefit of and incorporates herein by reference, U.S. Provisional Application Ser. No. 61/561,558, filed Nov. 18, 2011.

FIELD OF THE INVENTION

Drip trays and drip tray assemblies, more specifically, a drip tray assembly for engagement with a drain line for removing fluid accumulating in the drip tray.

BACKGROUND OF THE INVENTION

Drip trays function to both support a container on an upper surface thereof and to receive spilled beverages from a beverage dispenser. Drip trays need to be cleaned from time to time. Drip trays also may need to drain accumulated fluid therein so as to maintain a sanitary condition.

SUMMARY OF THE INVENTION

A drip tray and base assembly for a beverage dispensing urn is provided comprising an urn housing, a base for supporting the urn housing thereon in spaced apart relation to a support surface. The base includes a faceplate, the faceplate has a faceplate cutout. The faceplate cutouts having faceplate cutout walls. A drip tray is provided, the drip tray having a perimeter portion and a ribbed, grate-like top surface. The drip tray has a floor and a drain extension. A coupling member is configured to removably, toollessly engage the face plate cutout walls. The coupling member has inner walls defining a drain channel, the drain channel having a near and a removed end. The wall defining a drain channel is dimensioned for snug fluid tight, toolless coupling with the drain extension of the drip tray at the near end thereof. The drain channel has exterior walls at a removed end thereof, the exterior walls being dimensioned for snug receipt into the removed end of the drain line.

DETAILED DESCRIPTION OF THE PREFERRED EMBODIMENT

Figure 1:
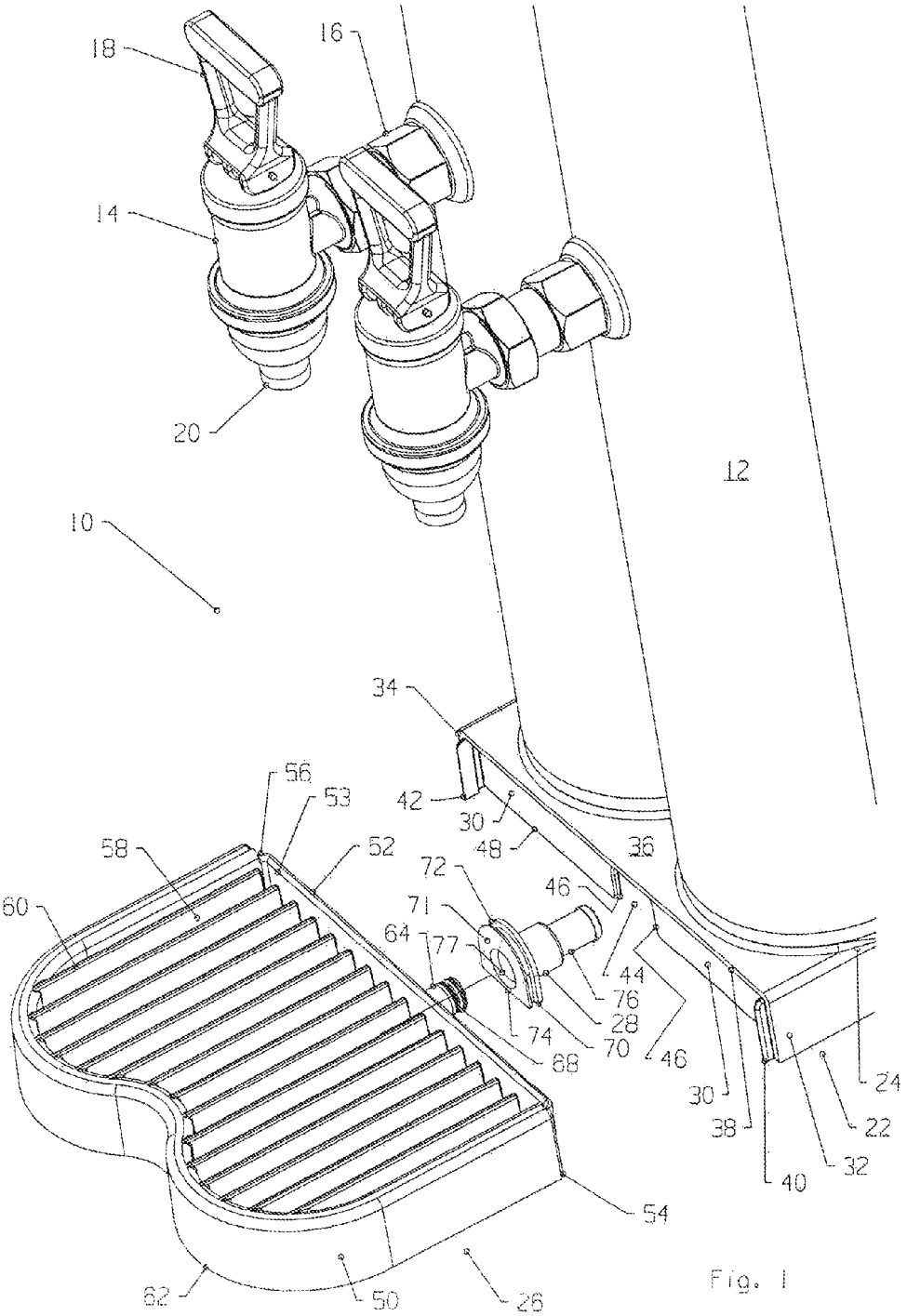
FIG. 1 is an exploded perspective view of the drip tray assembly and the urn of one embodiment of Applicant's device.
Figure 1A:
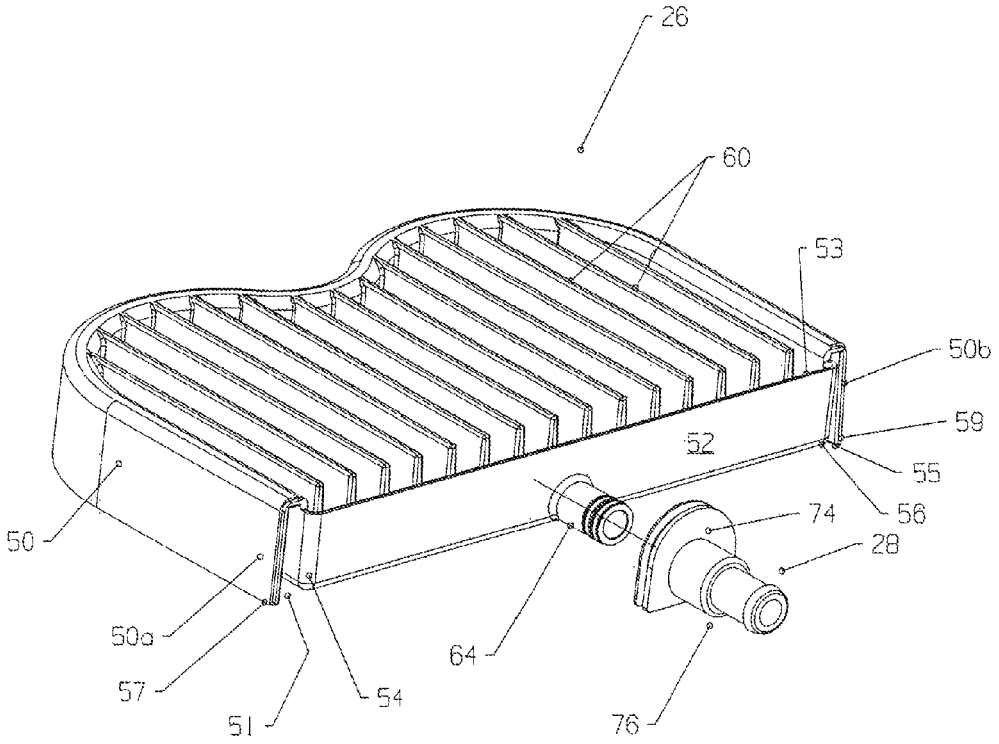
FIG. 1A is an exploded perspective view of the drip tray assembly.

FIGS. 1 and 1A illustrate a drip tray assembly comprising a drip tray 26 and a coupling member 28. The drip tray assembly will engage a base 22 of an urn 10. The urn 10 typically has an urn housing 12 with beverage dispensing valves 14 engaged therewith. Beverage dispensing valves 14 are disposed with nozzles above the drip tray. The drip tray 26 functions to support a beverage container (not shown) thereon and typically includes a top grate 58 having a multiplicity of ribs 60 thereon for allowing fluid to drain into the interior thereof. The interior of the drip tray 26 may be comprised of a floor 62, which may be integral with an upstanding perimeter wall 50 and an upstanding facing plate 52. Perimeter wall 50, facing plate 52, and floor 62 define an interior space that may contain a fluid.

Figure 5:
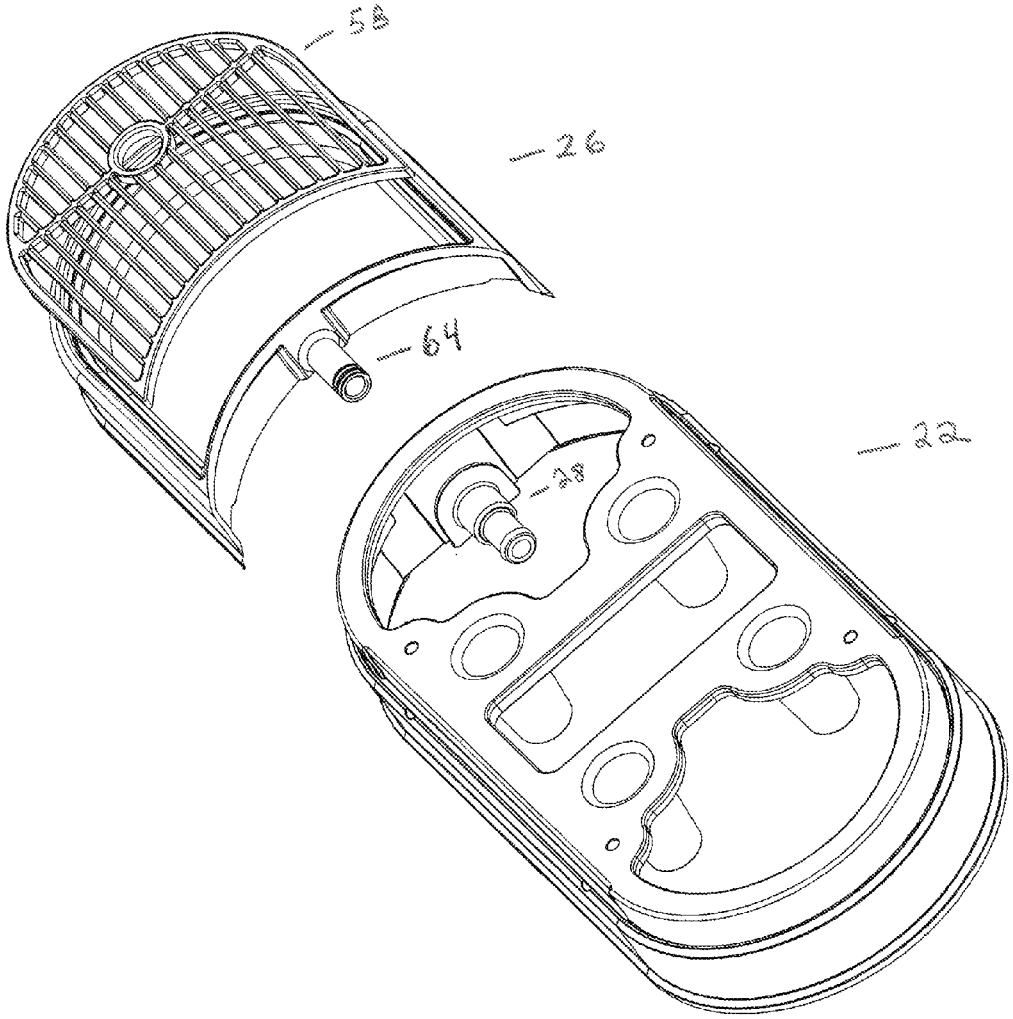
FIG. 5 is an exploded perspective view of the drip tray and base assembly with the drip tray having a removable top portion.

Applicant's drain tray 26 may be integral, that is, the top grate 58 being molded into other elements of the drip tray so it is not removable. In an alternate preferred embodiment, as seen in FIG. 5, top grate 58 is removable, so as to provide access to the interior of the drain for cleaning out fluids accumulating therein. When the drip tray 26 is integral, that is, the top grate 58 is not removable, the drip tray should be removed from the remainder of the urn for washing, for example, in a dishwasher.

Turning to the general construction of urn 10 in FIGS. 1 and 1A, it is seen that urn 10 may include a housing engagement conduit for engaging the valve or valves to the housing so they are in a spaced apart relation and above the drip tray. A handle 18 may be provided for dispensing a fluid from dispensing nozzle 20 of the one or more valves 14. Housing 12 may rest upon a base 22 that may include housing engagement members 24 for engaging a lower rim of the housing, the base for itself resting upon a support surface, such as a tabletop or other suitable support surface. Housing engagement members 24 are typically configured in ways known in the art to provide stability to the urn housing.

Figure 2:
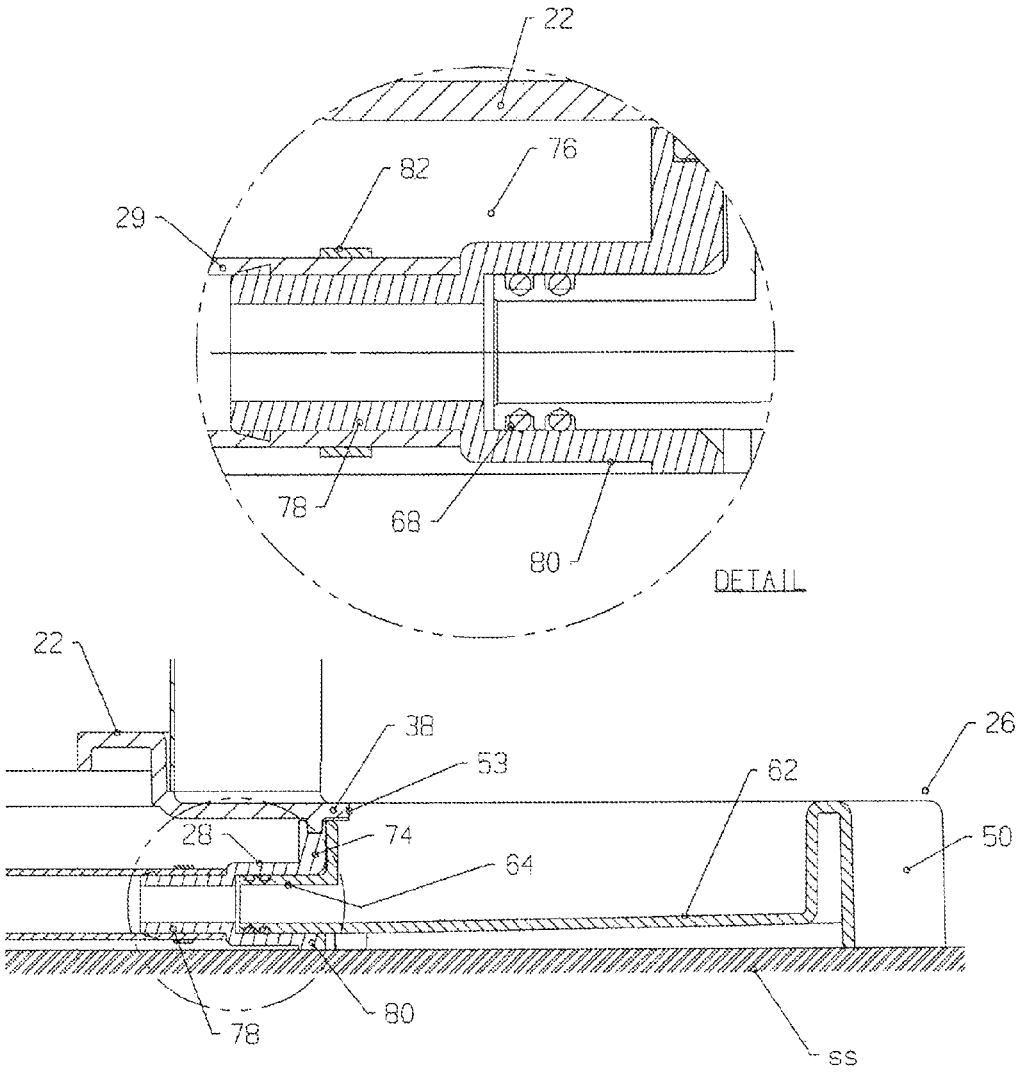
FIG. 2 is a cross-sectional view of the drip tray assembly coupled to the urn in the use position, including a detail view of the manner in which the drip tray drain extension couples to the coupling member in a toolless and fluid tight seal.
Figure 2A:
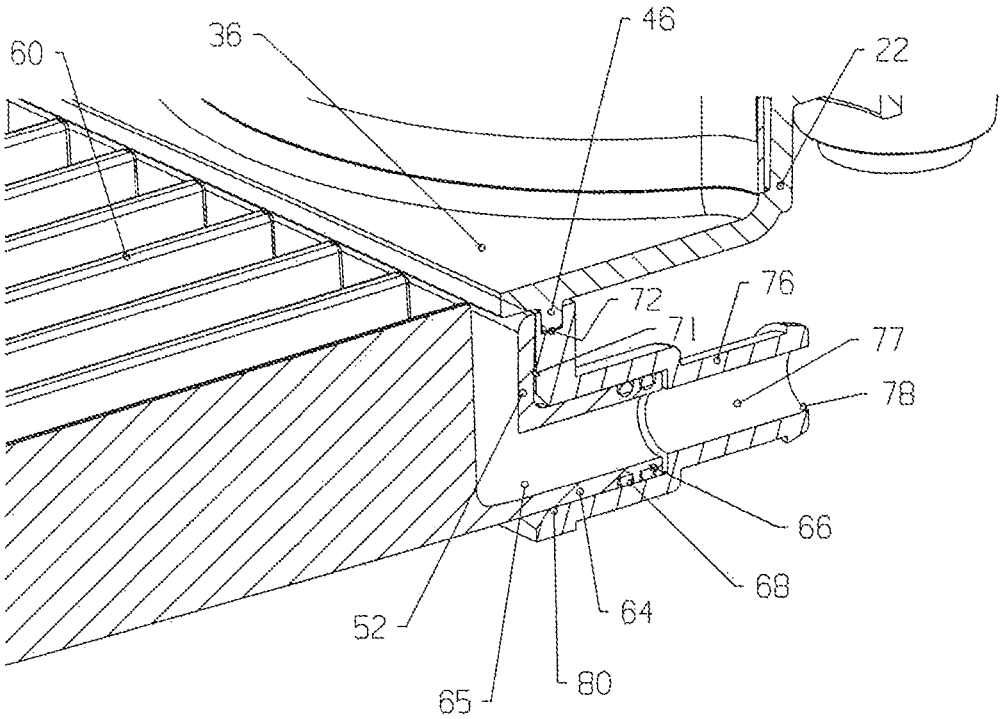
FIG. 2A is a perspective view cutaway of the coupling of the drip tray to the coupling member and the base of the view as seen in FIG. 2.
Figure 3:
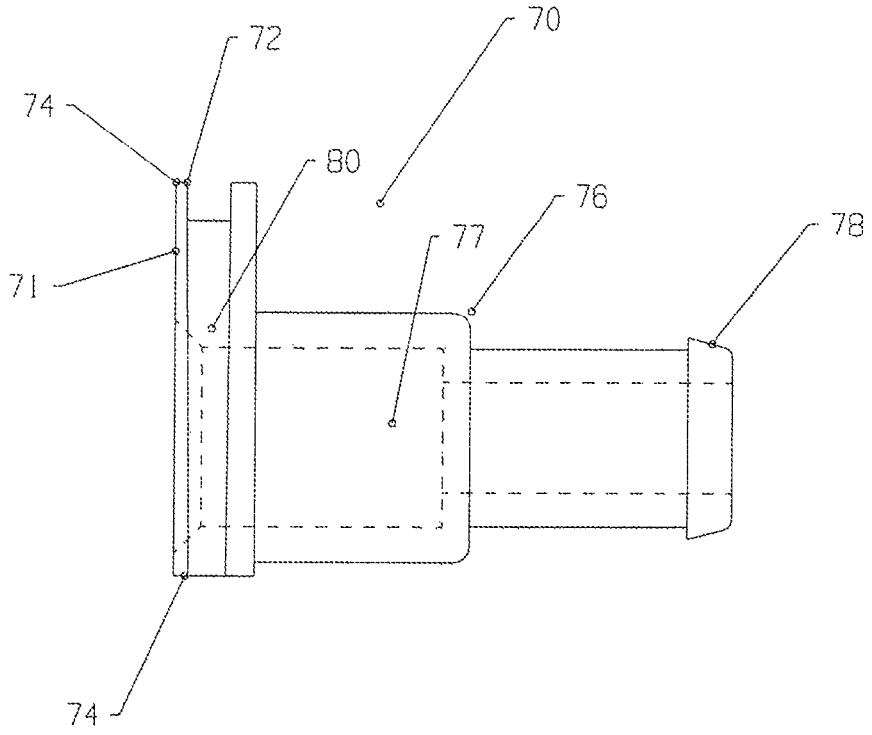
FIG. 3 is a side elevational view of the coupling member where it couples with the base of the urn.
Figure 4:
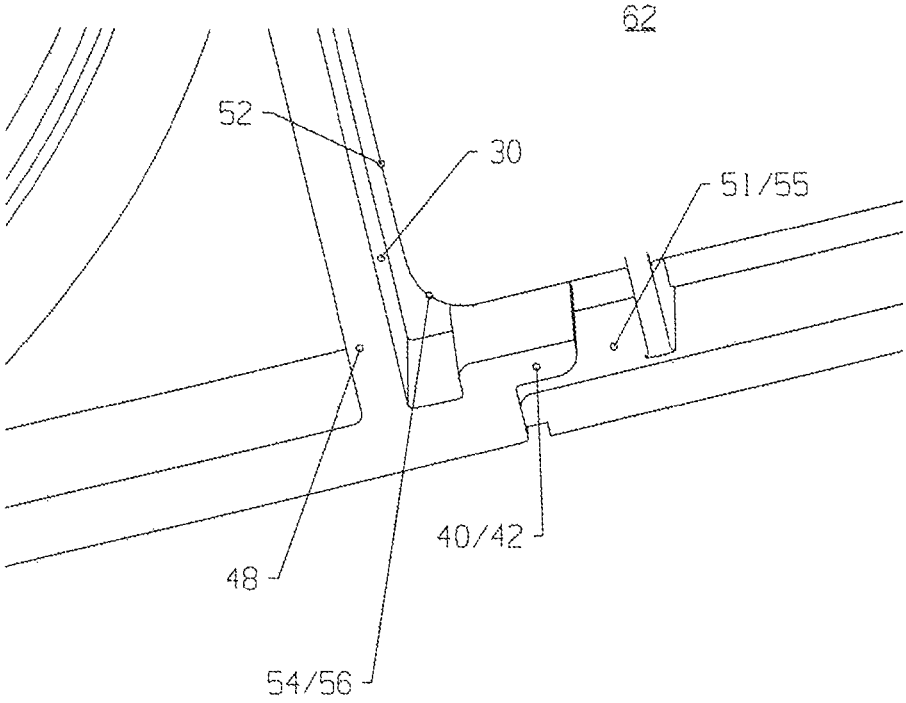
FIGS. 4 and 4A are detail perspective views of the elements of Applicant's structure for coupling elements of the base directly to elements of the drip tray.
Figure 4A:
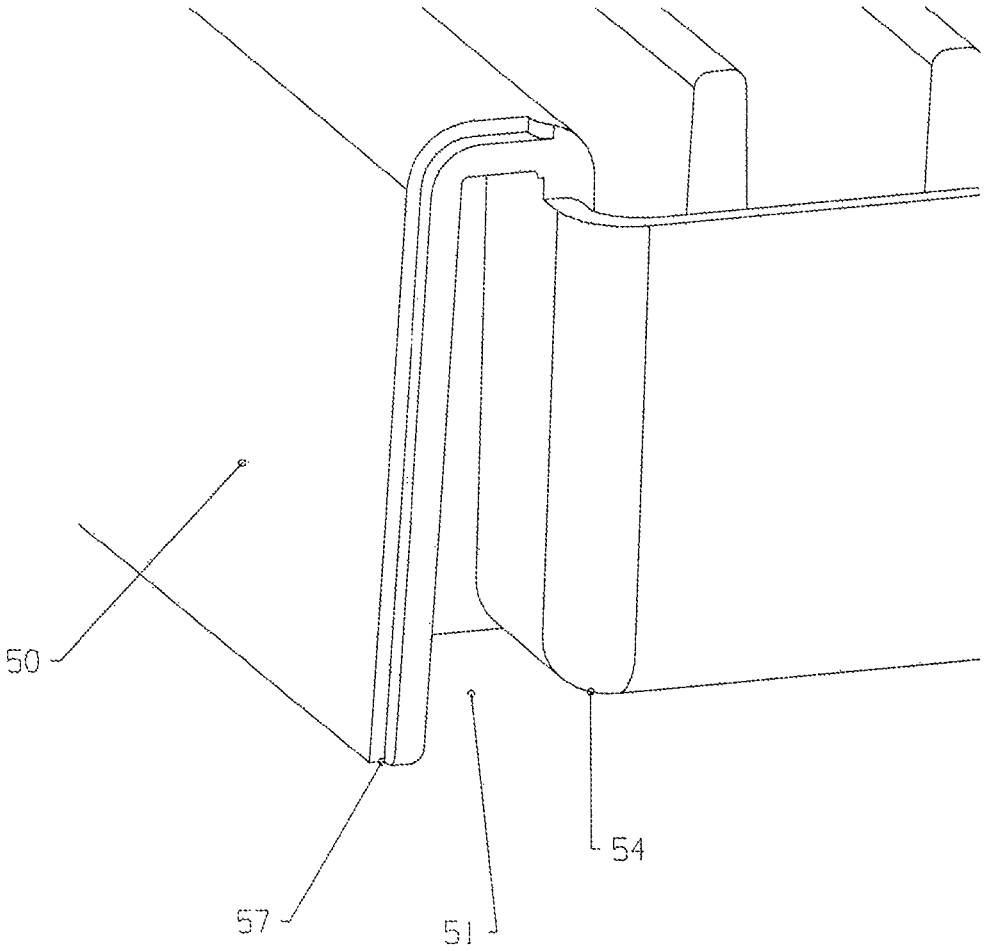

Applicant provides drip tray 26 and coupling member 28 to toollessly couple with one another in a fluid tight manner, so as to carry fluids accumulating in the drip tray away to a drain line 29 (see FIG. 2). A second function of the coupling member 28 is to assist in locating the drip tray adjacent the base, in a use position below the valves. Part of the base 22 may include a forward located, upstanding faceplate 30, which may be recessed back from a front rim 38 defining a forward edge of the base. The base 22 may have a top wall 36 and side walls 32/34. In addition, as seen in FIGS. 1, 4, and 4A, there may be lateral locating tabs 40/42 projecting forward from the front of the base to engage slots 51/55 of the drip tray to provide location and lateral stability to the drip tray when it is engaged to coupling member 28 and base 22 in a manner set forth in more detail below. Such coupling of tabs to slots is a direct coupling of the drip tray to the base.

Base 22 is seen to have a faceplate 30 having a cutout 44 that may be centrally located or located at any other suitable place along the faceplate. Cutout 44 is defined by cutout walls 46 and may be open to lower edge 48 of faceplate 30.

Figure 1B:
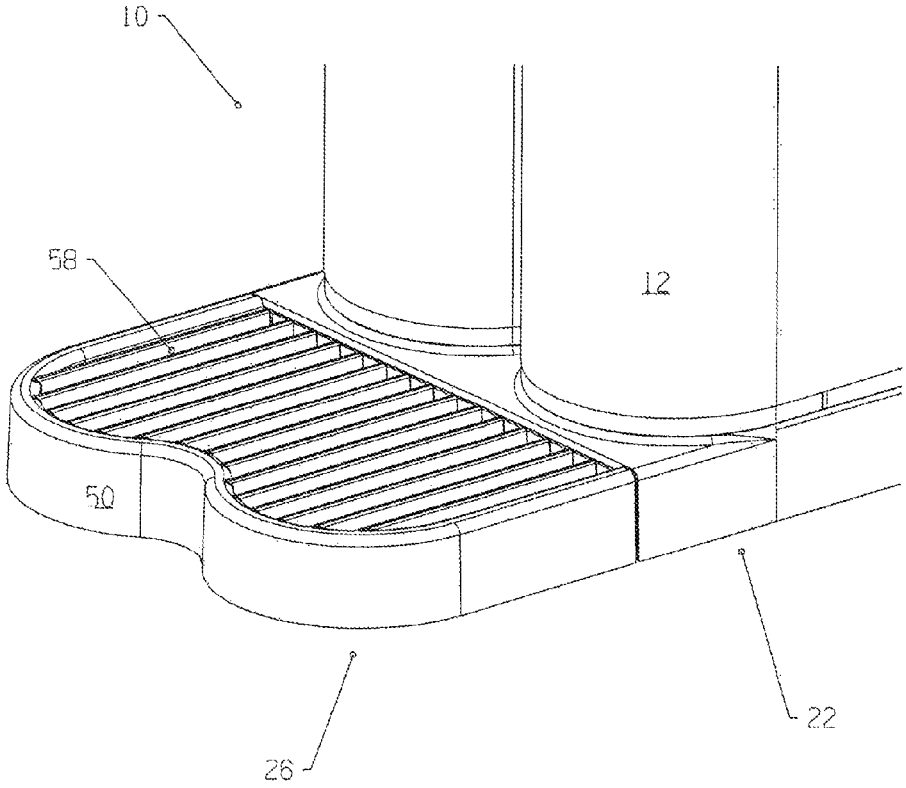
FIG. 1B is a perspective view of the drip tray coupled to the base of an urn in the use position

Turning now to drip tray 26, perimeter walls 50 are provided as well as a facing plate 52, which is dimensioned to lay substantially flush with faceplate 30 when drip tray 26 is coupled to coupling member 28, and coupling member 28 is coupled to cutout walls 46 and tabs 40/42 are located in slots 51/56 (as seen in FIGS. 1, 4, and 4A). Such a position is a "use position" placing the drip tray in a proper use position beneath the valves as seen in FIG. 1B. Note in FIG. 2, that perimeter walls 50 may be comprised of inner and outer segments, with the inner segment integral to floor 62.

Facing plate 52 may include lateral shoulders 54/56 that, along with the slots 51/55 and the removed ends 50*a*/50*b* of the perimeter walls 50 will help make a secure, stable toolless and fluid tight engagement of the tray to the base when the tray is in the use position (see FIG. 1B).

Turning now to the manner in which the fluid tight coupling occurs, it may be seen that a drain extension 64 extends forward or outward from facing plate 52 as seen in FIGS. 1, 1A, 2, 2A, and 3. Indeed, it is seen that drain extension 64 includes a channel 65 therein. Moreover, floor 62 slopes downward toward the drain extension 64 (usually the lowest point), so that it is able to collect the fluid (see FIG. 2).

Turning now to FIGS. 1, 1A, 1B, 2, and 2A, it is seen that both the structure and function of the drip tray/coupling member/drain base/drain tube may be appreciated. Those units join together structurally in the manner illustrated to drain fluid accumulating on the floor of the drip tray 26 through to drain tube 29 in a manner that allows the drip tray to be toollessly and easily removed from the base for cleaning. It is seen, for example, with reference to FIG. 2A, that cutout walls 46 of the base may couple with coupling groove 72 of the coupling member, such that base 74 of coupling member 28 is prevented from moving fore and aft or side to side by engagement with coupling groove 72 and walls cutout 46 in the manner illustrated. It may also be seen that a lower edge of base 74 is aligned with lower edge 48 of faceplate 30, so both are supported by a support surface, such as a tabletop. Moreover, it is seen with reference, for example, in FIGS. 2 and 2A, how drain extension 64 is located at the low spot in the floor, the channel 65, which is low enough to pick up accumulated fluid from a sloped floor will plug into extension member 76 of coupling member 28. Base 74 of coupling member 28 includes a face wall 71 that is flush with facing plate 52 and aligned with and in a common plane with recessed faceplate 30.

Turning back to FIGS. 2 and 2A, it is seen that, due to the locating effect of coupling 46/72, removal as by pulling the drip tray out along the axis of drain extension 64 and extension member 76 will allow O-rings 68 located in groove 66 to maintain a fluid tight coupling until they pass out of the extension member. Moreover, it is seen that channel 65 of drain extension 64 and drain channel 77 of coupler 28 have a common longitudinal axis. Moreover, extension member 76 has a near end 80 for snugly and telescopically receiving as a female the male drain extension 64 of tray 26. This coupling indirectly engages the drip tray to the base, through the coupling member. In an alternate embodiment, coupling member is integral to faceplate 30. Removed end 78 of extension member 76 is dimensioned for receipt as a male into female end of drain tube 29, as seen in FIG. 2, for example, and a clamp 82 may cinch the drain tube 29 to the outer walls of the removed end 78.

Although the invention has been described in connection with the preferred embodiment, it is not intended to limit the invention's particular form set forth, but on the contrary, it is intended to cover such alterations, modifications, and equivalences that may be included in the spirit and scope of the invention as defined by the appended claims.

The invention claimed is:

1. A drip tray and base assembly for engaging an urn housing of a beverage dispensing urn, the drip tray and base assembly comprising:

a base for supporting the urn housing thereon in spaced apart relation to a support surface, the base including a face plate, the faceplate having a face plate cutout, the face plate cutout having face plate cutout walls;

a drip tray, the drip tray having a perimeter portion, a facing wall, and a ribbed, grate-like top surface, the drip tray having a floor and a drain extension extending from the facing wall; and a coupling member configured to removably, toollessly engage the face plate cutout walls and the drain extension of the drip tray, the coupling member having walls defining a drain channel, said drain channel having a near and a removed end, the walls defining the drain channel for snug, fluid tight, toolless coupling with the drain extension of the drip tray in male/female or telescopic relation, the drain channel having exterior walls at a removed end thereof, the exterior walls dimensioned for snug receipt into an end of a drain line.

2. The drip tray and base assembly of claim 1, wherein the face plate and drip tray facing wall are substantially vertical and the drain extension extends from the vertical facing wall in a substantially horizontal direction.

3. The drip tray and base assembly of claim 2, wherein the base includes side walls spaced laterally from the face plate and a top wall, the side walls and the top wall having a contiguous rim.

4. The drip tray and base assembly of claim 3, wherein the faceplate is recessed with respect to the rim.

5. The drip tray and base assembly of claim 1, wherein the base and the drip tray have walls configured to releasably couple the drip tray to the base, such that in a coupled state with both the drip tray and base on a support surface compressive and lateral forces are resisted but tension forces of separation are not resisted.

6. The drip tray and base assembly of claim 1, wherein the coupling member includes a face wall and a groove dimensioned to engage with the faceplate cutout walls.

7. The drip tray and base assembly of claim 2, wherein the drip tray has a floor, the floor inclined to direct fluid to the drain extension thereof.

8. The drip tray and base assembly of claim 2, wherein the base and the drip tray have walls configured to releasably couple the drip tray to the base, such that in a coupled state with both the drip tray and base on a support surface compressive and lateral forces between the two are resisted but tension forces of separation are not resisted.

9. The drip tray and base assembly of claim 2, wherein the top surface of the drip tray is removable from the rest of the drip tray.

10. A drip tray and base assembly for engaging an urn housing of a beverage dispensing urn comprising:

a base for supporting the urn housing thereon in spaced apart relation to a support surface, the base including a face plate, the faceplate having a face plate cutout, the face plate cutout having face plate cutout walls;

a drip tray, the drip tray having a perimeter portion, a facing wall, and a ribbed, grate-like top surface, the drip tray having a floor and a drain extension extending from the facing wall; and a coupling member configured to removably, toollessly engage the face plate cutout walls and the drain extension of the drip tray, the coupling member having walls defining a drain channel, said drain channel having a near and a removed end, the walls defining the drain channel for snug, fluid tight, toolless coupling with the drain extension of the drip tray in male/female or telescopic relation, the drain channel having exterior walls at a removed end thereof, the exterior walls dimensioned for snug receipt into an end of a drain line;

wherein the face plate and drip tray facing wall are substantially vertical and the drain extension extends from the vertical facing wall in a substantially horizontal direction wherein the base includes side walls spaced laterally from the face plate and a top wall, the side walls and the top wall having a contiguous rim;

wherein the faceplate is recessed with respect to the rim;

wherein the base and the drip tray have walls configured to releasably couple the drip tray to the base, such that in a coupled state with both the drip tray and base on a support surface compressive and lateral forces are resisted but tension forces of separation are not resisted;

wherein the coupling member includes a face wall, a groove dimensioned to engage with the faceplate cut-out walls; and wherein the drip tray has a floor, the floor inclined to direct fluid to the drain extension thereof.

11. A drip tray and base assembly for a beverage dispensing apparatus, the drip tray and base assembly comprising:

a base for supporting an urn;

a drip tray having an upper grill-like surface, side walls, and a floor;

wherein at least one of the side walls is configured with a drain extension; and a coupling member with walls adapted to removably couple with the base, and to removably and fluid sealingly couple with the drip tray drain extension and a drain line.

12. The drip tray and base assembly of claim 11, wherein the coupling member and the drain extension are adapted to couple telescopically.

13. The drip tray and base assembly of claim 11, wherein the walls adapted to sealingly couple with the drip tray drain extension and the drip tray drain extension are generally horizontally diagonal.

14. The drip tray and base assembly of claim 11, wherein the coupling member and the drain extension are adapted to couple telescopically; and wherein the walls adapted to sealingly couple with the drip tray drain extension and the drip tray drain extension are generally horizontally diagonal.

* * * * *